United States Patent [19]

Hohorst et al.

[11] 3,945,711

[45] Mar. 23, 1976

[54] SCREWLESS CONNECTOR OR COUPLING FOR ELECTRIC LEADS

[75] Inventors: Wolfgang Hohorst, Minden; Hans-Josef Koëllmann, Voltlage, both of Germany

[73] Assignee: Wago-Kontakttechnik GmbH, Minden, Germany

[22] Filed: Apr. 4, 1974

[21] Appl. No.: 457,968

[30] Foreign Application Priority Data

Apr. 5, 1973 Germany ..... 2317040

[52] U.S. Cl. ..... 339/95 D; 339/248 S; 339/256 R

[51] Int. Cl.[2] ..... H01R 11/20

[58] Field of Search ..... 339/95 R, 95 D, 113 R, 339/242, 248 R, 248 S, 252 R, 252 S, 258 R, 256 R, 256 S, 273 S

[56] References Cited

UNITED STATES PATENTS

| | | | |
|---|---|---|---|
| 2,617,844 | 11/1952 | Sanda | 339/95 D |
| 2,968,780 | 1/1961 | Roswell | 339/95 D X |
| 3,392,366 | 7/1968 | Nakazawa | 339/242 X |
| 3,638,171 | 1/1972 | Huibrechtse | 339/256 R X |

FOREIGN PATENTS OR APPLICATIONS

| | | | |
|---|---|---|---|
| 1,350,460 | 12/1963 | France | 339/113 R |

*Primary Examiner*—Gerald A. Dost
*Assistant Examiner*—E. F. Desmond
*Attorney, Agent, or Firm*—Edmund M. Jaskiewicz

[57] ABSTRACT

A screwless connector or coupling for electric leads, having a clamping spring located in an insulating material housing and retained therein, forming with a contact bridge at least one conductor clamping position, wherein the contact bridge and the clamping spring are substantially flat and are interconnected at a common end region to form a self-supporting unitary structure, the contact bridge being provided at a point spaced from the point where the contact bridge and clamping spring are connected with a plurality of conductor bush openings arranged in spaced juxtaposition, the clamping spring in the region of each contact bridge bush opening having at least one clamping edge located behind the contact bridge in the insertion direction of the conductor.

23 Claims, 13 Drawing Figures

SCREWLESS CONNECTOR OR COUPLING FOR ELECTRIC LEADS

Figure 1:
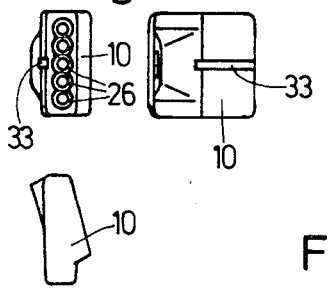

The invention relates to a screwless connector or coupling for electric leads, having a contact bridge located in an insulating material housing (terminal housing) and carrying a clamping spring forming with the contact bridge at least one conductor terminal point.

It is an object of the invention to improve such a screwless connector and provide it with a high contact pressure with small surface contact for an inserted conductor together with means preventing accidental pulling-out of the conductor.

A further object of the invention consists in providing an assembly accommodating a plurality of conductors, a low overall height, and narrow width.

Each connector is self-supporting and does not transmit the contact pressure occurring during conductor insertion to the insulating material housing.

The connector accepts conductors of various cross-sections reliably without damage.

A further object of the invention is to provide conductor disengaging means which is simple and easy to operate.

In accordance with the invention there is provided a screwless connector or coupling for electric leads, having a clamping spring located in an insulating material housing and retained therein, forming with a contact bridge at least one conductor clamping position, wherein the contact bridge and the clamping spring are substantially flat and are interconnected at a common end region to form a self-supporting unitary structure, the contact bridge being provided at a point spaced from the point where the contact bridge and clamping spring are connected with a plurality of conductor bush openings arranged in spaced juxtaposition, the clamping spring in the region of each contact bridge bush opening having at least one clamping edge located behind the contact bridge in the insertion direction of the conductor.

In such a connector either the free end face of the clamping spring remote from the contact bridge clamping spring connecting region has a clamping edge on the side adjacent to the contact bridge, acting wedge-like on a conductor and preventing it from being accidentally pulled out; alternatively the free edge region remote from the contact bridge clamping spring connecting region of the clamping spring is bent away or at an angle from the clamping spring plate plane and from the contact bridge, and in this shaped region a wedge-like clamping recess is provided, acting on a conductor and retaining it against being accidentally pulled out. One or both clamping spring clamping edges are provided transversely, preferably extending at right angles to the conductor insertion direction, and straight or concavely curved.

The width of each clamping web is equal to the cross-sectional size of a conductor assembly (conductor plus insulation) entering the insulating housing so that a connector assembly receiving several conductors has a width which corresponds to the sum of the sizes of the conductor cables connectable in parallel to the assembly, at least in the region of the insulating material housing.

Socket openings in the assembly or contact bridge may be formed by strips punched or bent out of the contact bridge side remote from the clamping spring, and which face in the direction of the contact bridge clamping spring connection region and subtend an acute angle with the plane of the contact bridge and an abutment and guide surface for the inserted conductors.

In a preferred form, the clamping spring has at least one end region of its plate extension pressing against the contact bridge and the contact bridge has several webs formed as rivet parts across its width, and the clamping spring is provided in accordance with the number and form of the contact bridge rivet parts with inserting openings in the connection region, through which the contact bridge rivet parts engage and are secured to the contact bridge by riveting to the clamping spring side remote from the contact bridge.

Conductors enter from one side of the connector assembly where they parallel to one another and in one row, but end leads may extend in any direction.

The assembly or contact bridge forms a self-supporting unitary structure with the clamping spring. It receives the contact pressures occurring and does not transmit them to the housing.

In the clamping positions of the assembly conductors of varying cross-sectional size may be clamped in position independently of one another, since each contact bridge socket opening for a conductor has an independent spring tongue, with a clamping edge.

The clamping point for the conductors is close to the contact bridge clamping spring connecting position so that the clamping spring exerts a high contact pressure on the conductors.

The clamping spring is not weakened anywhere in its cross-section, since there are no recesses in the clamping spring between the contact bridge connecting point and the clamping spring clamping edge.

The clamping edge is located at the free end of each clamping lug, or is formed by a free-end recess in the clamping spring, this recess also is adjacent the first clamping edge of the spring lug without weakening it.

The clamping edge or edges act wedge-like on the conductors, which are retained securely against accidental detachment by one or both clamping edges.

In the clamped state the clamping spring and the contact bridge assume a V-shaped position relative to one another, and are proportional, so that lever arms for the clamping force are provided. A conductor can be removed from a connector only by simultaneously applying a pull and rotation to the conductor, so that accidental detachment is impossible.

This connector is particularly suitable for use in conjunction boxes on account of its small volume and large number of conductors accommodated. In a normal junction box the use of connectors in accordance with the invention easily permits up to five or more items to be enclosed.

The connector is designed for at least 220/380 volts and is used wherever only a small space is available for many connections.

Figure 2:
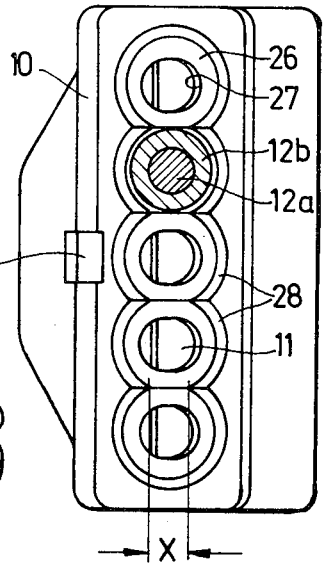
Figure 13:
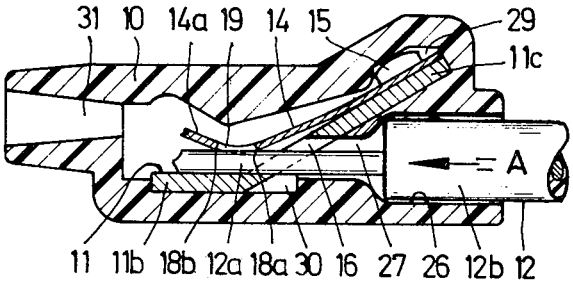
Figure 3:
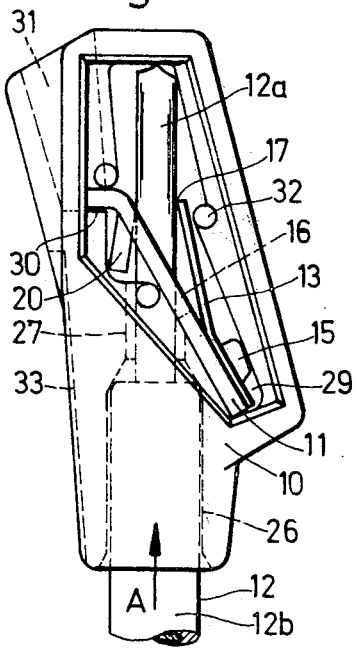
Figure 4:
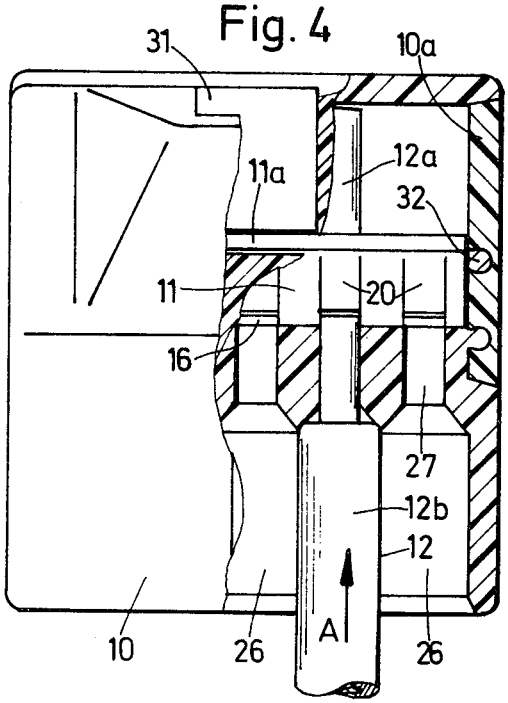
Figure 5:
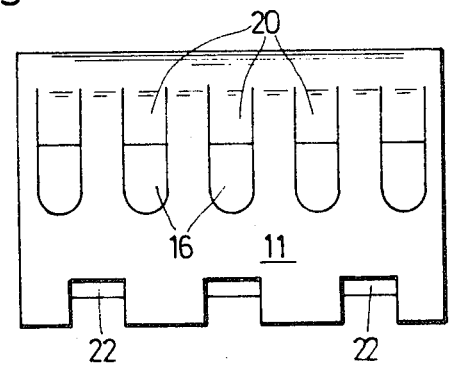
Figure 6:
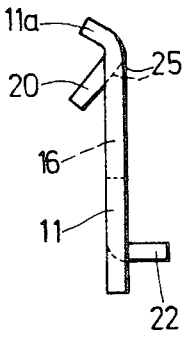
Figure 8:
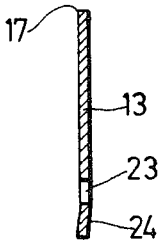
Figure 7:
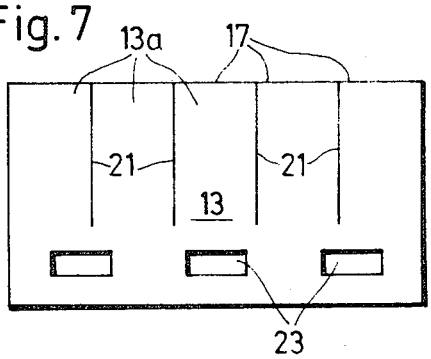
Figure 9:
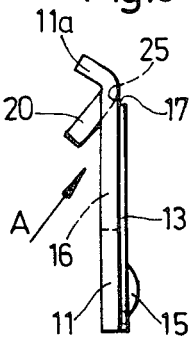
Figure 12:
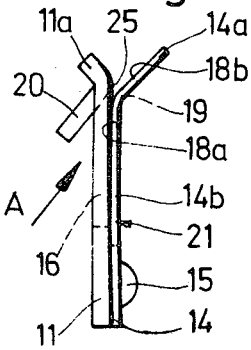
Figure 11:
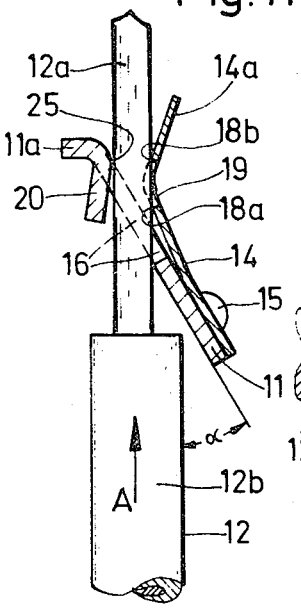
Figure 10:
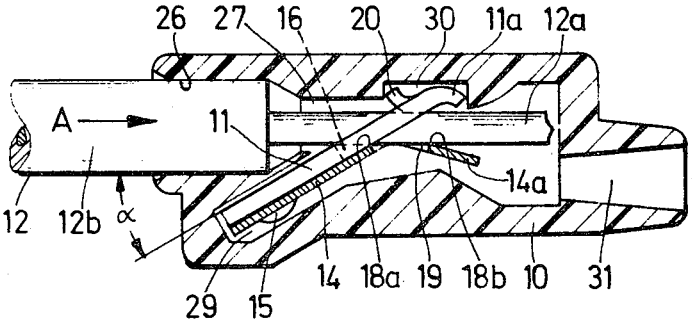

Examples of the invention are shown in the drawings, in which:

FIG. 1 is a screwless connector in three views (end view, side view and plan view) and full size, FIG. 2 is an end view of the connector from the insertion side, FIG. 3 is a side view of the connector with a contact bridge in an insulating material housing, a clamping spring connected therewith and an electric conductor clamped therein, FIG. 4 is a plan view of the same connector, partly in section, with an inserted conductor, FIG. 5 is an end view of a contact bridge with several juxtaposed conductor insertion openings, FIG. 6 is a side view of the contact bridge of FIG. 5, FIG. 7 is a side view of a clamping spring with several juxtaposed spring webs forming a free-end clamping edge, FIG. 8 is a side view in longitudinal section of the same clamping spring, FIG. 9 is a side view of the terminal formed from a contact bridge according to FIGS. 5 and 6 and a clamping spring according to FIGS. 7 and 8, FIG. 10 is a longitudinal section through a modified form of connector, having a contact bridge located in the insulating material housing and a clamping spring retained thereon, FIG. 11 is a longitudinal section through a connector according to FIG. 10 with slightly modified contact bridge and a clamping spring retaining a conductor inserted between clamping edges, FIG. 12 is a side view of the connector of FIG. 10 in the unused state, FIG. 13 is a longitudinal section through a connector with an obtuse-angle contact bridge.

The numeral 10 denotes an insulating material housing of a screwless connector in accordance with the invention, in which there is a contact bridge 11 and a clamping spring 13, 14 forming with the contact bridge 11 at least one clamping position, preferably several spaced apart clamping positions, for a conductor 12*a* or an electric lead 12. The contact bridge 11 and the clamping spring 13, 14 are strip-shaped and are originally flat and connected together in a common end region; the contact bridge 11 is provided at a distance from the contact bridge clamping spring connecting region 15 with at least one lead conductor bush opening 16 and at least the clamping spring 13, 14 in the region of this opening 16 there being at least one clamping edge 17 or 18*a*, 18*b* spaced in the direction of insertion of the conductor (see arrows in FIGS. 3, 4, 9, 10, 11 and 12) behind the contact bridge clamping spring connecting region 15.

The clamping spring 13 in FIGS. 3, 8 and 9 forms a clamping edge 17 at its free end face remote from the conductor 12*a*, acting wedge-like on the conductor 12*a* and retaining it from being accidentally pulled out.

In FIGS. 10 to 12 the clamping spring has its end region remote from the connecting region 15 bent over or at an angle from the plane of the spring and away from the contact bridge 11, and thus provides a spring region 14*a* and enclosing an acute angle with the plane of the contact spring.

In the region between clamping spring 14 and bent-over spring end 14*a* there is a recess 19 which forms two clamping edges 18*a*, 18*b* in the direction of insertion of the conductor, spaced one behind the other and acting wedge-like on the conductor 12, retaining the latter secured against being accidentally pulled out.

One spring clamping edge 17 or both spring clamping edges 18*a*, 18*b* extend transversely, preferably at right angles, to the direction of insertion of the conductor and are straight or concavely curved.

In its longitudinal edge region remote from the connecting region the contact bridge 11 is provided with several bush openings 16 spaced from one another.

These are spaced from the free longitudinal edge and are formed by punched and bent out webs 20.

All bush openings 16 are equidistantly spaced from one another and extend spaced from the free longitudinal edge of the contact bridge and from the connecting region over a certain contact bridge width, extending in the direction of insertion. The webs 20 forming the openings 16 are bent out relative to the side of the contact bridge opposite the clamping spring 13, 14 and their free ends extend contrary to the direction of insertion of the conductors and enclose an acute angle with the contact plate 11.

The clamping spring 13, 14 is divided by several incisions 21 extending from the longitudinal edge opposite the connecting region 15, dividing the spring 13, 14 into several spring tongues 13*a*, 14*b* corresponding numerically to the bush openings 16 of the contact bridges, and which extend from the free longitudinal edge of the spring to occupy a part region of the spring width whilst merging into one other in the connecting region 15.

Each spring web 13*a* has a clamping edge 17 at its free end and each spring web 14*b* has a recess 19 or a cut-out of square or rectangular form resulting in two clamping edges 18*a*, 18*b*.

The clamping spring 13 extends in the longitudinal direction of the spring webs 13*a* substantially over the whole length of the contact bridge, from the connecting region 15 to the bush opening 16 of the contact bridge 11, so that its clamping edge 17 is located in the edge region of the bush opening 16 remote from the connecting region; the clamping spring 13 is of such a length that it fully covers the bush opening and its clamping edge 17 is located in the bent region of the web 20.

The free end 11*a* of the contact bridge 11 adjacent to the web 20 is bent out of the plane of the contact bridge (FIGS. 6, 9, 11, 12) either towards the side of the contact bridge remote from the clamping spring 13, 14 or towards the clamping spring (FIG. 10); this bent edge 11*a* extends towards the webs 20 and subtends an acute angle with the contact bridge 11.

The clamping spring 13, 14 has its end remote from the clamping edges 17, 18*a*, 18*b* connected to the contact bridge 11 by rivets or screws, so that the clamping spring 13, 14 has one end secured to the contact bridge 11, and its other end facing the clamping edge 17 or clamping edges 18*a*, 18*b* can move to receive a conductor.

The contact bridge 11 is provided in its region opposite the bush openings 16 with two or more tongues 22 punched and bent out of the contact bridge 11, and the clamping spring 13, 14 at its edge remote from the clamping edge 17 or edges 18*a*, 18*b* has recesses or apertures 23 corresponding in number and form to the contact bridge tongues 22, into which contact bridge 11 with tongues 22 engage, producing a secure connection between the contact bridge 11 and clamping spring 13, 14.

Over at least a part of its length the clamping spring 13, 14 in its normal condition presses against the contact bridge 11. To obtain the clamping spring pretension to exert contact pressure on the conductor 12*a*, it is expedient to bend the clamping spring 13, 14 before assembly in a direction towards the contact bridge 11, as shown at 24 in FIG. 8, so that during the riveting of the clamping spring in position the spring is drawn against the contact bridge 11 and its clamping edge 17 or edges 18*a*, 18*b* press against the bridge.

The clamping spring is provided with between two and five clamping webs 13*a*, 14*b* and the contact bridge 11 receives a corresponding two to five bush openings 26.

The clamping spring 13, 14 is made of a resilient metal such as spring steel, and the contact bridge 11 of a non-resilient metal such as a brass alloy.

The clamping spring 13, 14 and the contact bridge 11 are of a rectangular basic shape, their width, as determined by the plurality of juxtaposed clamping positions 16, 18, 18*a*, 18*b* is larger than their length, with reference to the direction of insertion of the conductor.

The assembly including the contact bridge 11 and the clamping spring 13 or 14 secured thereto, has a clamping position (opening 16 and clamping edge 17 or 18*a*, 18*b*) for each conductor 12*a*, which in width corresponds to the maximum cross-section of an electric lead 12, i.e. the cross-sectional diameter of conductor 12*a* plus insulation sheath 12*b;* the maximum diameter of the insulating sheath 12, which also enters the housing, determines the width of the clamping position, since the lead 12, away from the assembly, may increase in insulation thickness 12*b*, and the maximum diameter of a normal insulation sheath 12*b* is regarded as the width between the clamping positions.

The overall width of the whole assembly is determined by the number of conductors 12 to be connected.

In the embodiment of the assembly with five terminal positions (five spring webs 13*a*, 14*b* and five bush openings 16) the width of the assembly corresponds to the sum of the diameters of all five lead insulations 12*b*, and the leads 12 therein are parallel but the part of each conductor 12 outside the housing 10 can be bent over in any desired direction.

The assembly is particularly suitable for electric leads 12 with single core (rigid) conductors 12*a*. It may, however, be used for stranded conductors 12*a*, though for such conductors it is preferable for the bared ends to be inserted in the assembly to be made rigid by soldering.

The end of lead 12 with its end stripped of insulation — the exposed wire 12*a* — is inserted in the direction of the arrow "A" into the bush opening 16 of the contact bridge 11, from the connection-side edge region of the assembly at an acute angle towards the contact bridge 11. The conductor 12*a* during passage through the opening 16 pushes the end of the clamping spring 13, 14 away from the contact bridge, and continues between contact bridge 11 and clamping spring clamping edge 17 or 18*a*, 18*b*, to project beyond the free edge of the contact bridge 11 and the clamping spring 13, 14.

As shown in FIG. 3 of the drawing, the conductor 12*a* has a part of its surface abutting against the free-end clamping edge 17 and another part against the bent out tongue 20, which constitutes a support. The conductor 12*a* in the embodiment shown in FIGS. 3 and 5 to 9 is supported at point 25. The clamping spring end edge 17 adjacent to the contact bridge 11 abuts wedge-like against the conductor 12*a* and assumes an acute angle relative to the longitudinal direction of the conductor.

As shown in FIGS. 10 and 11, the conductor 12*a* has part of its surface abutting against the bent-out tongue 20, and also against the web surface 25; its surface also engages the two clamping edges 18*a*, 18*b* which press wedge-like against the conductor, which is retained securely between the contact bridge 11 and the clamping spring 14 at three points. The clamping spring region facing the clamping edge 18*a* assumes an acute angle to the longitudinal direction of the conductor and its bent-over end which has the other clamping edge 18*b*, assumes an acute angle relative to the longitudinal direction of the conductor.

Extraction of the conductor 12*a* in a longitudinal direction is prevented by the wedge action of the clamping edge 17 or edges 18*a*, 18*b;* it is thus necessary to perform a conscious extraction action by pulling on the lead 12 in a longitudinal direction and simultaneously twisting or turning the conductor 12 to and fro about its longitudinal axis. This enables the conductor 12*a* to be pulled out gradually from its clamping position. The setting angle of the lead 12 (the conductor 12*a*) relative to the clamping plane (i.e. the acute angle between the longitudinal direction of the conductor and contact bridge 11 during the insertion or after insertion) determines the extent of the disengagement movement. By varying the setting angle this movement may be varied in length. For example with an acute angle of setting of between 10° and 30° the detachment (distance) is shorter than with an angle of between 30° and 60°.

The bush opening 16 and the tongue 20 of the contact bridge 11 form a guidance channel for the conductor 12*a* during its insertion in the assembly.

All leads 12 are inserted into the terminal from one side.

Since the insulating material housing 10, more particularly if of plastics material has the physical shape of a rectangular block and is provided on one side — the end face determining the thickness of the block — with all the insertion openings 26 for the leads 12, so that the housing 10 only has one connection side.

The insertion openings 26 (one for each terminal point) receive a certain length of the lead 12 with insulation 12*b* and taper to a conductor guide passage 27 in which the conductor 12*a* is advanced into the contact bridge 11; this passage 27 is of larger diameter than the diameter of the bush opening 16 of the contact bridge.

The insertion openings 26 merge one into the other in the assembly width and are formed by two segment members 28 and two annular ring portions provided at the width ends of the assembly. The distance "X" (FIG. 2) between the opposing segment members 28 of adjacent insertion openings 26 merging one into the other is smaller than the minumum insulation sheath thickness of the lead 12; each lead 12 has its own guide and leads of varying thickness may be inserted in the assembly.

The connector including contact bridge 11 and clamping spring 13 or 14 is secured in position in the housing 10; for example, the edge region on the connection side and the clamping spring 13, 14 rests in a groove 29 of the housing 10. The contact bridge 11 with its tongues 20 pressed out and bent over the edge 11*a*, is located in a recess 30.

The end face of the housing 10 opposite the insertion openings 26 has a test opening 31 for testing the supply voltage.

The housing 10 is closed on all sides with the exception of the connection-side insertion openings 26 and the test opening 31 opposite thereto. The integral housing has a lateral opening provided for installing the contact bridge 11 and spring 13, 14, which after assembly is closed by a cover 10*a* detachably located by means of a stop 32 which is fastened or welded to the housing.

On the outside of the housing 10 there is an insulation stripping marker formed by a straight groove 33 which extends from the connection side and indicates the length of insulation to be stripped from the conductors.

Each connector (contact bridge 11 with clamping spring 13, 14) is made self-supporting and no contact pressure is transmitted to the insulation material housing; all contact pressure is absorbed within the assembly.

The assembly of the invention provides spring forces which ensure as high as possible contact pressure. The pressing surface (clamping edge 17, 18*a*, 18*b*) between clamping spring 13, 14 and conductor 12*a* is kept small to obtain the maximum contact pressure with the spring force available.

The high pressure obtainable from a small contact surface is clearly shown below:

Example

| | | |
|---|---|---|
| Force exerted by the clamping spring | = | 1.5 kp (14.7 N) |
| Surface available between clamping spring and conductor (wire) | = | 0.2 mm² |
| contact pressure | = | 7.5 kp/mm², (corresponding to = 73.2 N ) |

An alternative form of screwless connector is shown in FIG. 13 and corresponds in basic structure and in mode of operation to the connector shown in FIGS. 10 and 11. If a contact bridge 11 bent at an obtuse angle in a longitudinal direction and a clamping spring 14 also bent at an obtuse angle in a longitudinal direction the obtuse angle shapes of both parts 11, 14 facing in the same direction. The contact bridge 11 has two shanks 11*b*, 11*c* of different length, of which the longer shank 11*c* serves to secure the clamping spring 14. The clamping 14 is fastened to the free end of the longer shank 11*c* of the contact bridge 11 by connecting means 15 and both parts form a self-supporting unitary structure.

The contact bridge 11 is provided in the angle between its two shanks 11*b*, 11*c*, more particularly in the longer shank 11*c*, with spaced juxtaposed conductor bush openings 16. The longer shank of the clamping spring 14 forms the securing shank and the shorter shank 14*a* secures the spring; the clamping spring 14 has several juxtaposed clamping spring webs 14*a* separated by slots and independent of one another, permitting conductor reception. In the joint region of the two clamping spring shanks, the recesses 19 form the clamping edges 18*a*, 18*b;* a recess 19 is formed in each clamping spring web 14*a*.

The contact bridge 11 has its longer shank 11*c* located in a groove 29 and its shorter shank 11*b* in a recess 30 of the insulating material housing 10.

It is also possible in forming the two clamping edges 18*a*, 18*b* to provide the recess 19 with an oval, circular or other suitable shape.

In a further embodiment, not shown, a housing 10 accommodates units each formed from a contact bridge 11 and a clamping spring 13, 14 having several juxtaposed clamping positions, so that in such an assembly two juxtaposed rows of terminal connections are provided; hence to save space it is preferred to locate the individual terminal positions of the two unitary structures offset relative to one another i.e. between each two adjacent terminal positions of a unitary structure a terminal position of the other unitary structure is located, but spaced therefrom.

We claim:

1. A screwless connector or coupling for electric leads, having a clamping spring located in an insulating material housing and retained therein, forming with a contact bridge at least one conductor clamping position, wherein the contact bridge and the clamping spring are substantially flat and are interconnected at a common end region to form a self-supporting unitary structure, the contact bridge being provided at a point spaced from the point where the contact bridge and clamping spring are connected with a plurality of conductor bush openings arranged in spaced juxtaposition, the clamping spring in the region of each contact bridge bush opening having at least one clamping edge located behind the contact bridge clamping spring interconnection in the insertion direction of the conductor.

2. A connector according to claim 1, wherein the free end of the clamping spring forms a clamping edge acting wedge-like on a conductor and securely retaining the conductor against being pulled out accidentally.

3. A connector according to claim 1, wherein the end region of the clamping spring remote from the contact bridge is bent out of the plane of the clamping spring and away from the contact bridge and in this region there is a recess or hole forming two clamping edges acting wedge-like on an inserted conductor to retain the conductor from being accidentally pulled out.

4. A connector according to claim 3, wherein said clamping spring has an edge extending transversely to the direction of insertion of a conductor and is one of straight or concavely curved.

5. A connector according to claim 4, wherein the contact bridge has a plurality of juxtaposed bush openings and the clamping spring is provided with a plurality of spring webs on its free movable end located at a spacing corresponding to the contact bridge bush openings formed by incisions led in from the free edge over a part of the length of the clamping spring in the direction of the connection region, each having an end clamping edge or two clamping edges located in said end region.

6. A connector according to claim 5, wherein the width of each clamping spring web is at least equal to the maximum diameter of a conductor plus insulation inserted into the insulation material housing.

7. A connector according to claim 6, having a plurality of conductor receiving positions or bush openings arranged side by side across the width of the connector.

8. A connector according to claim 7, wherein bush openings in the contact bridge are formed by webs pressed out of the bridge towards the side of the bridge remote from the clamping spring so as to subtend an acute angle with the plane of the contact bridge.

9. A connector according to claim 8, wherein the webs of the contact bridge forming the bush openings at least adjacent the bush openings form an abutment and guide surface for the inserted conductors.

10. A connector according to claim 9, wherein the free width edge region of the contact bridge is bent out of the plane of the contact bridge towards one side of the contact bridge to define a position locating web.

11. A connector according to claim 10, wherein the clamping spring abuts at least with a portion of its length against the contact bridge with pre-tension and has a strip region bent in the connection region towards the contact bridge causing the pre-tension.

12. A connector according to claim 11, wherein the contact bridge in its connection width region has several webs formed out as rivet parts and the clamping spring is provided in the connecting region with bush openings in accordance with the number and shape of the contact bridges, through which openings the contact bridge rivet parts engage and are riveted for locating the clamping spring on the contact bridge on the clamping spring side remote from the contact bridge.

13. A connector according to claim 12, wherein the clamping spring is provided with the clamping edge at its free end face extending in the direction of width of the terminal, with its end on the clamping edge side covering at least a part region of the bush openings of the contact bridge.

14. A connector according to claim 13, wherein the clamping spring is provided with the two clamping edges on its spring webs in the region of the bush opening on each contact bridge and has the end region bent at an acute angle from the contact bridge and the two clamping edges located in the region of the bush opening.

15. A connector according to claim 14, wherein each contact bridge has a plurality of spring tongues in an end thereof and each spring tongue of the clamping spring and the contact bridge in the clamped state of the conductor assume a V-shaped position relative to one another, and hence the V-shanks formed by the clamping spring webs and the contact bridge attend in a straight line and in the V-apex the contact bridge clamping spring connection is located.

16. A connector according to claim 15, wherein the recess of each spring web of the clamping spring forming the clamping edges has an angular, such as square or rectangular basic shape.

17. A connector according to claim 16, wherein each contact bridge web has the bush opening extending over that portion of the contact bridge length between the connecting region and the clamping spring.

18. A connector according to claim 17, wherein the terminal formed of contact bridge and clamping spring accommodates at least two and five conductors at a maximum in juxtaposition and adapted to be inserted from the end region at the coupling side, the insulating material housing having on one side all conductor insertion openings and only one connection side.

19. A connector according to claim 18, wherein the contact bridge in the longitudinal direction has two shanks of different length defining an obtuse angle between them, the free end region of the longer shank has thereon clamping spring aligned in the longitudinal direction and has several spring webs with their recesses located in the angle joint of said shanks and forming the clamping edges.

20. A connector according to claim 19, wherein the terminal housing for each lead is provided with an insert passage of sufficient size to receive the lead with insulation thereon, there being a conductor guide passage opening from said insert passage, the conductor guide passage being larger in diameter than the width of the bush opening for the contact bridge to initially guide the conductor into said bush opening.

21. A connector according to claim 20, wherein the insertion passages in the terminal width merge into one another and are formed by two segment parts opposing one another transversely to the terminal width, whereby the distance between opposing segment members of adjacent insertion openings in the distance extending at right angles to the terminal width is smaller than the minimum insulation thickness.

22. A conductor according to claim 21, wherein an edge portion of the contact bridge on the connection side is received in a bearing opening together with an end region on the clamping spring, and an edge portion of the contact bridge on the web-side is retained in a bearing recess of the housing.

23. A connector according to claim 22, wherein the housing is closed on all sides with the exception of the insertion openings and at least one test hole, the housing having the shape of a rectangular block and at the one face has the connections side with the insert openings, the housing having an open assembly side, which is closed by a cover by means of weld connections and on the outer surface of the housing an insulation removing mark for the lead being provided formed by a groove.

* * * * *